US007654292B2

(12) United States Patent
Sweningson

(10) Patent No.: US 7,654,292 B2
(45) Date of Patent: Feb. 2, 2010

(54) EROSION CONTROL DEVICE

(75) Inventor: Roger Sweningson, 34064 Highway 47 NW., Cambridge, MN (US) 55008

(73) Assignee: Roger Sweningson, Cambridge, MN (US)

( * ) Notice: Subject to any disclaimer, the term of this patent is extended or adjusted under 35 U.S.C. 154(b) by 553 days.

(21) Appl. No.: 11/332,769

(22) Filed: Jan. 13, 2006

(65) Prior Publication Data

US 2006/0151057 A1 Jul. 13, 2006

Related U.S. Application Data

(60) Provisional application No. 60/643,985, filed on Jan. 13, 2005.

(51) Int. Cl.
*B65B 1/04* (2006.01)

(52) U.S. Cl. ..... 141/231; 141/12; 141/71; 141/314; 414/326; 414/353; 414/394; 414/725; 298/24; 37/420

(58) Field of Classification Search ..... 141/10, 141/12, 71, 108, 114, 231–233, 256, 284, 141/313, 314; 414/326, 351, 353, 392, 394, 414/487, 491, 526, 725; 298/24; 222/413; 37/420, 903; 366/26; 172/108; 100/145, 100/904; 53/469, 576
See application file for complete search history.

(56) References Cited

U.S. PATENT DOCUMENTS 3,593,484 A * 7/1971 Dussich ..... 53/439
4,055,255 A * 10/1977 Vasquez ..... 414/21
4,184,522 A * 1/1980 Waite ..... 141/231
4,864,748 A * 9/1989 Boyer ..... 37/142.5
5,004,022 A 4/1991 Carlsson
5,279,407 A * 1/1994 Shobak ..... 198/677
5,519,985 A * 5/1996 Dyck et al. ..... 53/527
5,564,886 A 10/1996 Emerson et al.
5,592,760 A * 1/1997 Kohout ..... 37/403
5,740,950 A * 4/1998 Kanzler et al. ..... 222/238
5,827,038 A 10/1998 Barden
5,873,396 A 2/1999 Biebrach et al.
5,894,871 A 4/1999 Greer
5,901,762 A * 5/1999 Rollins ..... 141/360
5,947,347 A 9/1999 Cline, Sr.
7,178,224 B2 * 2/2007 Bussey et al. ..... 29/728
2004/0144857 A1 * 7/2004 Kost et al. ..... 239/268

* cited by examiner

*Primary Examiner*—Timothy L Maust
*Assistant Examiner*—Jason K Niesz
(74) *Attorney, Agent, or Firm*—Patterson, Thuente, Skaar & Christensen, PA

(57) ABSTRACT

Methods and apparatus related to an erosion control device for constructing a barrier bag for use in areas where erosion is likely to occur. The erosion control device can include an attachment member allowing the erosion control device to be operably mounted to a skid steer, front-end loader, tractor or similar vehicle for transportation and power. The erosion control device can include a loading box defining a material hopper for holding a filler material. The loading box can further comprise a beater bar assembly for agitating the filler material within the material hopper so as to continually feed an auger assembly within the loading box. The auger assembly transports and compacts the filler material within a filling chute. The compacted filler material exits the filling chute and enters into a barrier bag that is continually deployed from the filling chute.

16 Claims, 14 Drawing Sheets

EROSION CONTROL DEVICE

PRIORITY CLAIM

The present application claims priority to U.S. Provisional Patent Application No. 60/643,985 filed Jan. 13, 2005, entitled, "EROSION CONTROL DEVICE," which is herein incorporated by reference in its entirety.

FIELD OF THE INVENTION

The present invention relates generally to an apparatus and associated methods for constructing a barrier bag to be used in areas where erosion is likely to occur. More specifically, the present invention relates to an erosion control device having a material hopper for accommodating filler material and a fill chute and filling components for packing the filler material into an erosion control bag.

BACKGROUND OF THE INVENTION

Environmental concerns have generated many laws and regulations concerning erosion control. Typically any construction project that disrupts an existing surface drainage system requires some form of barrier to prevent the loss of soil and protect nearby property and storm water/sewer systems. Existing barriers usually involve a silt fence which is a plastic sheet suspended by a series of stakes. These barriers are labor intensive to construct and inefficient. Such barriers create problems themselves as the stakes and bottom of the sheet need to be anchored. The act of anchoring, or partially burying the fence creates an erosion problem. Moreover, a silt fence is incapable of protecting property in the presence of significant water levels. Frequently, the silt fence is rendered non-functional after being knocked over by wind or water or alternative, the water flow through a path under the fence. As a result, there is a need for an easily installed erosion barrier capable of withstanding high water levels at a cost comparable to a silt fence.

SUMMARY OF THE INVENTION

The present invention addresses the aforementioned needs of easily creating and installing erosion barriers. An erosion control device of the present invention generally comprises a portable machine for constructing a barrier bag about areas where erosion is likely to occur. The erosion control device can include an attachment member allowing the erosion control device to be operably mounted to a skid steer, front-end loader, tractor or similar vehicle for transportation and power. The erosion control device generally includes a loading box defining a material hopper for holding a filler material. The loading box can further comprise a beater bar assembly for agitating the filler material within the material hopper so as to continually feed an auger assembly within the loading box. The auger assembly transports and compacts the filler material within a filling chute. The compacted filler material exits the filling chute and enters into a barrier bag that is continually deployed from the filling chute. A filled barrier bag can be deployed directly at a point-of-use so as to create the erosion barrier or a filled barrier bag can be deployed onto a shipping platform wherein the filled barrier bag can be transported to a point-of-use. Embodiments of the erosion control device of the present invention can utilize a variety of filler materials such as, for example, mulch, wood chips, compost, gravel, sand, or any other material suitable for filling the barrier bag. In some embodiments, the beater bar and auger assemblies can be hydraulically powered so as to be compatible with the power take off (PTO) of the transport vehicle.

In one aspect, the present invention comprises an erosion control device having a loading box and filling chute. The loading box generally defines a material hopper and further includes a beater bar assembly and an auger assembly. The loading box can include an attachment member allowing the erosion control device to be attached to and manipulated by a transport vehicle such as, for example, a skid steer, a front-end loader, a tractor of similar implement. The loading box can include a hydraulic power assembly compatible with a power take-off on the transport vehicle. A barrier bag can attach to an end of the filling chute for receiving a compacted filler material from the loading box.

In another aspect, the present invention can comprise an erosion control system for forming erosion control barriers. Generally, the erosion control system can comprise an erosion control device and a transport vehicle wherein the erosion control device is used to fill continuous barrier bags while the transport vehicle positions the filled barrier bags at a point of use or on a transport vehicle.

In another aspect, the present invention is directed to methods of forming erosion control barriers. In one embodiment, the erosion control barrier can be formed by filling a loading box with a barrier filler material, agitating the barrier filler material within the loading box so as to continually feed an auger assembly and directing a compacted filler material through a filling chute and into a barrier bag. In some embodiments, the erosion control barrier can be formed at a point-of-use or alternatively, the erosion control barrier can be formed and placed on a transport vehicle for transport to a point-of-use. In one embodiment, the loading box can be filled by manipulating the loading box with a transport vehicle such that the loading box scoops filler material from a bulk pile of filler material. In another embodiment, the loading box can be continually filled by a loading vehicle at the same time the erosion control barrier is being formed.

In another aspect, an erosion control device of the present invention can comprise a bottom load auger extending from within a loading box and a filling chute for filling a barrier bag with a compacted filler material. An auger free end of the bottom load auger can be spaced apart from a filling chute end such that the barrier material can be compacted before flowing into the barrier bag. The distance between the auger free end and the filling chute end can vary based on the diameter of filling chute and the desired barrier bag diameter. The filling chute can also include a flared collar that helps direct and maintain deployment of the filled barrier bag off of the filling chute. The flared collar can include a tension member so as to positively retain and stretch the barrier bag allowing the barrier bag to be completely filled with the compacted filler material and to prevent the bag from simply flowing or falling off the filling chute end. The compacted filler material forces the barrier bag away from the flared collar as the filler material is pushed and compacted by the bottom load auger.

In another aspect, barrier bags of any desired length can be quickly and easily filled and deployed through the use the erosion control device with a barrier bag having any suitable continuous length such as, for example, bag lengths from about 10 feet to about 400 feet. Depending upon environmental conditions, the barrier bag can be selected to have a suitable diameter such as, for example, from about 8 inches to about 24 inches. Barrier bags can be constructed of plastic, reinforced plastic, burlap or other suitable material. Barrier bags are selected for use with erosion control devices of the present invention such that a barrier bag diameter closely matches a filling chute diameter on the erosion control device.

Once filled and deployed, the filler material within the barrier bag maintains the barrier bag in a selected position for erosion control. Filled barrier bags of the present invention can be formed and deployed directly as points-of-use or alternatively, can be formed and placed on a transport vehicle for transport and use at a location remotely located from the forming location. After the filled barrier bag reaches its desired length, the barrier bag may be cut and/or removed from the filling chute and tied off in a closed disposition.

In another aspect, the present invention relates to continuous barriers formed with porous bags and absorbent filler materials for isolation and absorbing spill damages. In one representative example, a continuous barrier can be formed with a porous bag and an oil absorbent filler material for containing and absorbing a localized oil spill.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1A:
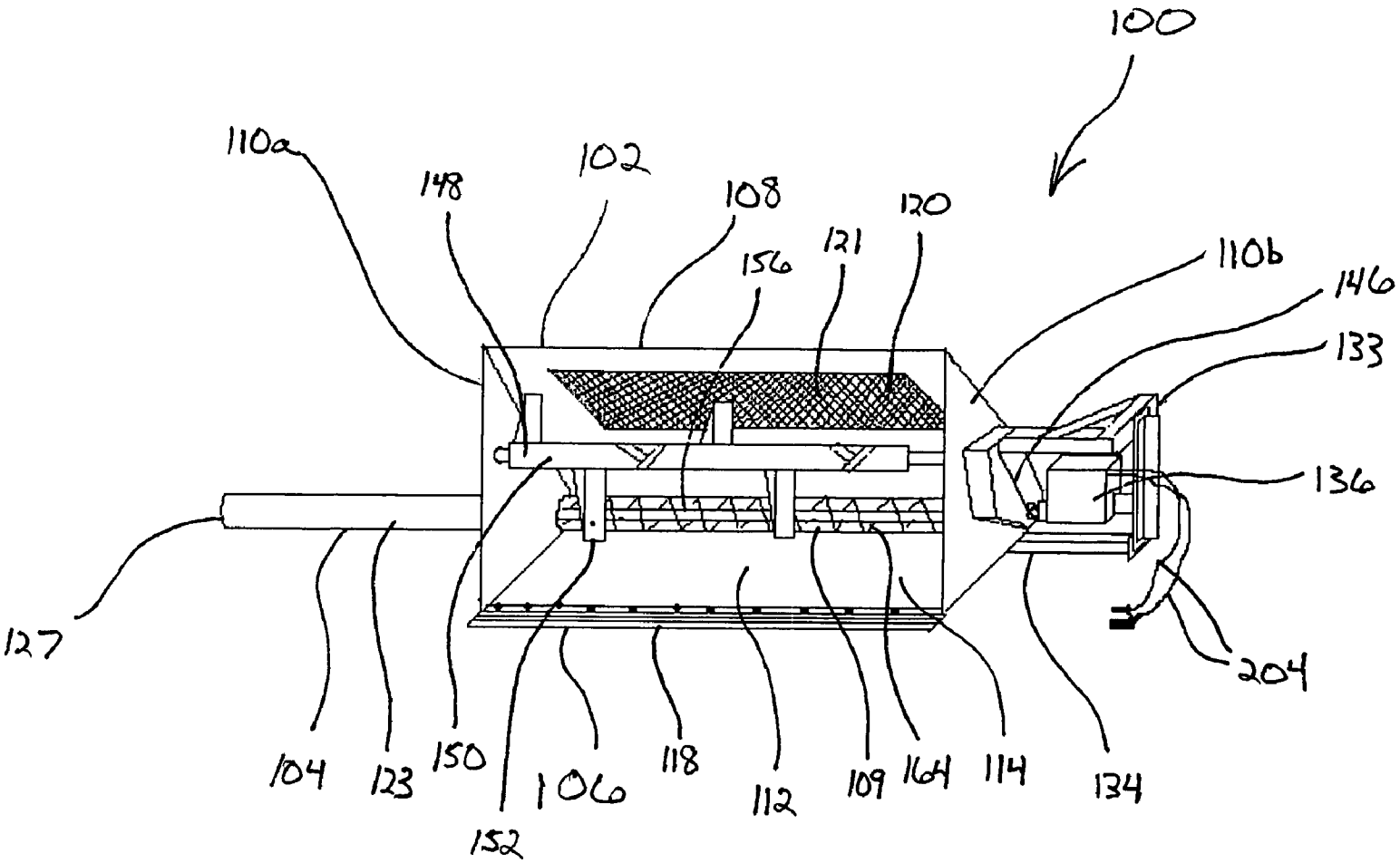
FIG. 1*a* is a front perspective view of an embodiment of an erosion control device of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 1B:
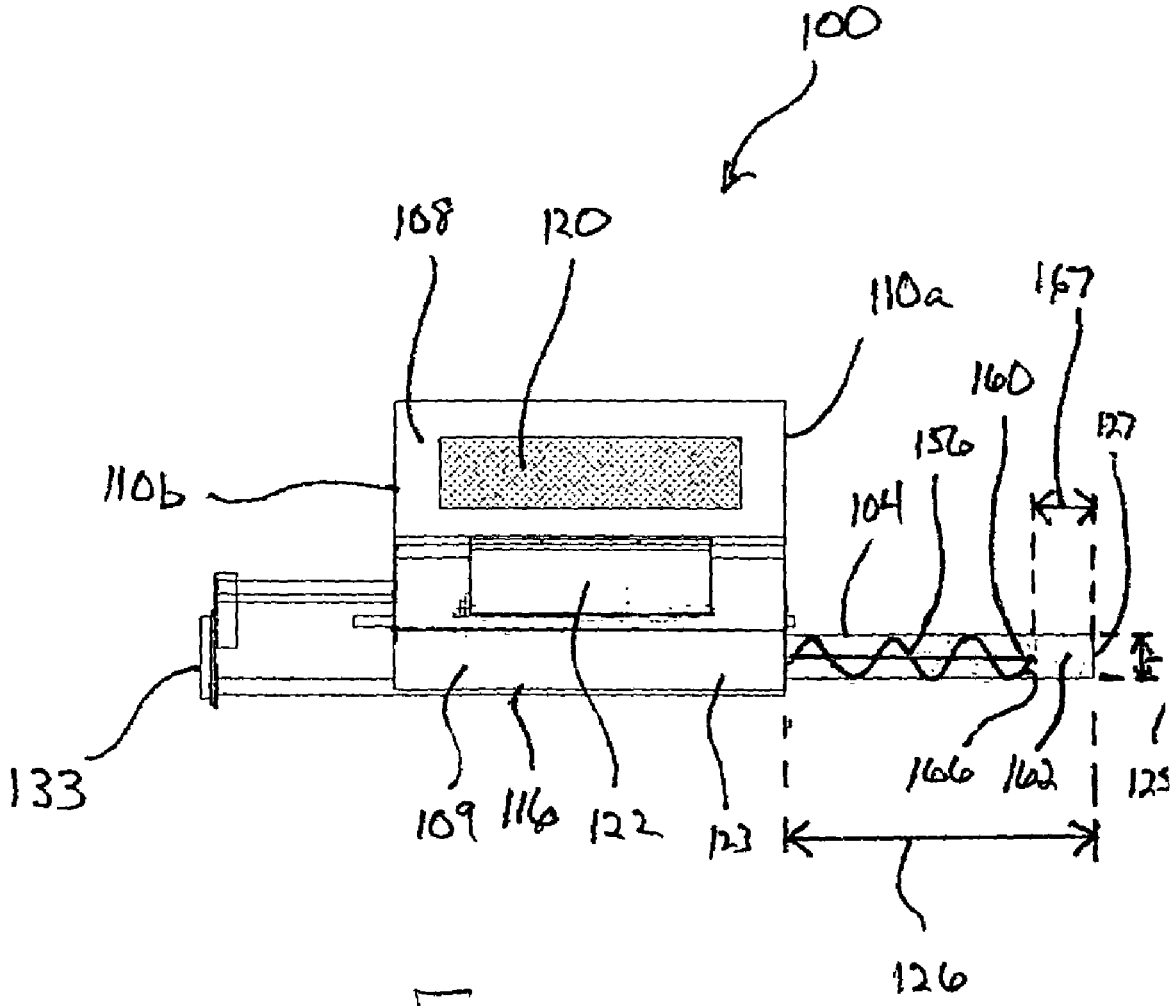
FIG. 1*b* is a rear view of the erosion control device of FIG. 1*a* including a partial cut-away view of a filling chute and auger assembly.
Figure 2:
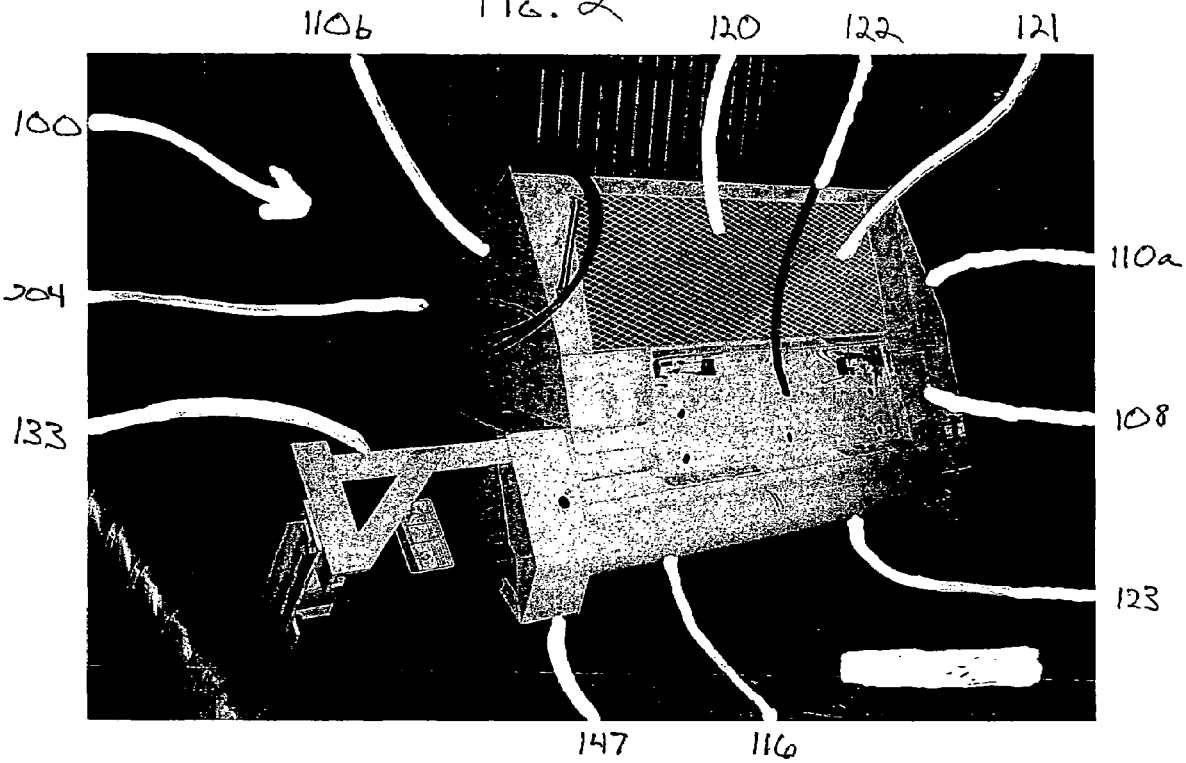
FIG. 2 is a rear perspective view of the erosion control device of FIG. 1*a*.

An embodiment of an erosion control device 100 is shown generally in FIGS. 1*a* and 1*b*. Erosion control device 100 generally comprises a loading box 102 and a filling chute 104. Erosion control device 100 is generally fabricated of heavy-duty materials such as, for example, welded carbon steel and the like.

As illustrated in FIGS. 1*a* and 1*b*, loading box 102 generally includes a bottom wall 106, a top wall 108, an auger chute 109 and a pair of side walls 110*a*, 110*b* cooperatively defining a material hopper 112. Loading box 108 has a loading opening 114 and a closed end 116 wherein bottom wall 106, top wall 108 and auger chute 109 are joined. Bottom wall 106 can include a leading edge 118 proximate the loading opening 114. Leading edge 118 can comprise a variety of alternative arrangements to promote scooping a filler material from a bulk filler pile. Representative configurations for leading edge 118 can comprise an angled and/or tapered surface with respect to the bottom wall 106 or can comprise a plurality of teeth or similar configurations or combinations thereof. Top wall 108 can comprise a viewing portion 120 for providing an operator a view of the material hopper 112 when the operator is located near the closed end 116. Viewing portion 120 can comprise perforations or slots placed within the top wall 108 or alternatively can comprise a separate material such as, for example, a sheet of expanded metal 121 or a polymeric window mounted within the top wall 108. Top wall 108 can further include an attachment mount 122 such as, for example, a universal skid-steer mount, allowing the erosion control device to be quickly attached to and manipulated by a transport vehicle.

Figure 4:
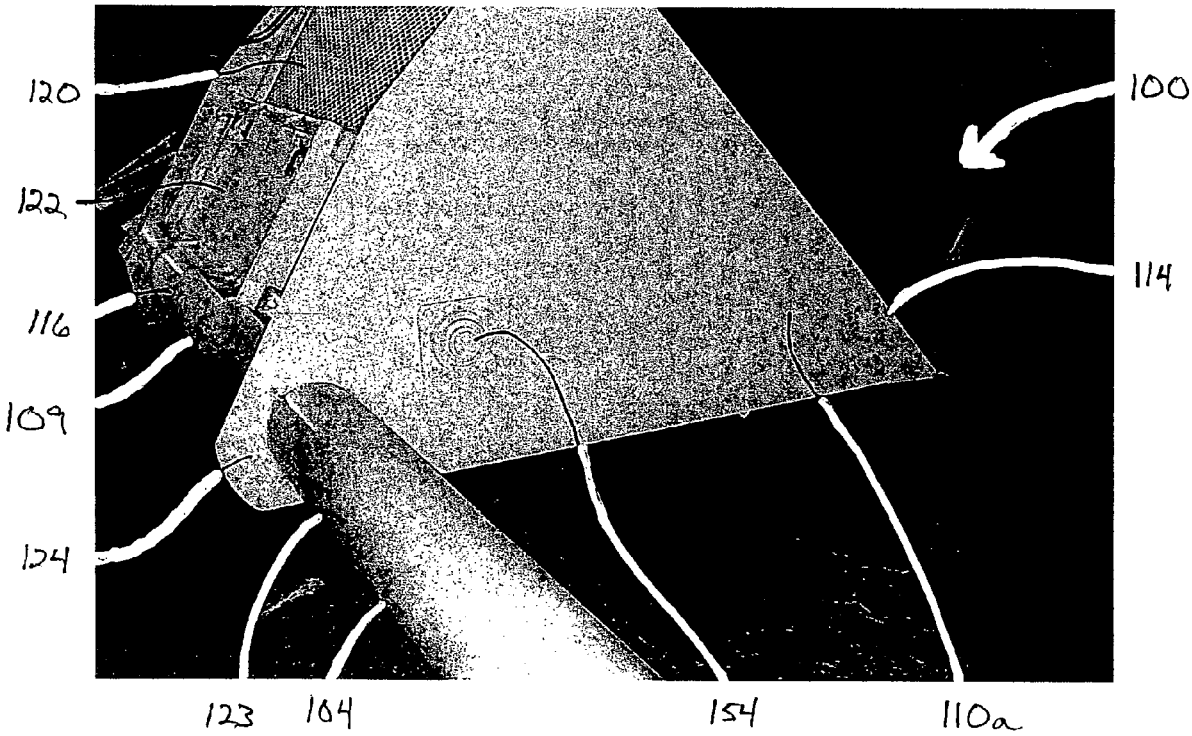
FIG. 4 is a side perspective view of the erosion control device of FIG. 1*a*.

As best illustrated in FIGS. 1*b* and 4, filling chute 104 and auger chute 109 generally comprise adjacent portions of a continuous pipe member 123 wherein a portion of the pipe member 123 is cut-away to define auger chute 109. The continuous pipe member 123 attaches to the loading box 102 by welding the auger chute 109 to the bottom wall 106, a top wall 108 and side walls 110*a*, 110*b*. Attachment of the continuous pipe member 123 to the side walls 110*a*, 110*b* can be further reinforced by incorporating one or more flanged connectors 124 around the continuous pipe member 123 and using suitable fasteners such as, for example, nuts and bolts.

As shown in FIG. 1*b*, filling chute 104 and auger chute 109 generally comprises a chute diameter 125 corresponding to the continuous pipe member 123. Filling chute 104 further comprises a chute length 126, wherein the chute length 126 is defined between a chute discharge end 127 and the side wall 110*a*. Chute discharge end 127 can include a bag attachment member 129 such as, for example, a flared collar or tensioning member for operably attaching and retaining an empty barrier bag on the filling chute 104. Chute diameter 125 can comprise a variety of typical pipe diameters such as, for example, 8 or 12 pipe diameters and is generally determined by the desired diameter for a filled barrier bag. Continuous pipe member 123 can be fabricated of the same heavy-duty materials as bottom wall 106, top wall 108 and side walls 110*a*, 110*b* such as, for example, carbon steel.

Figure 5:
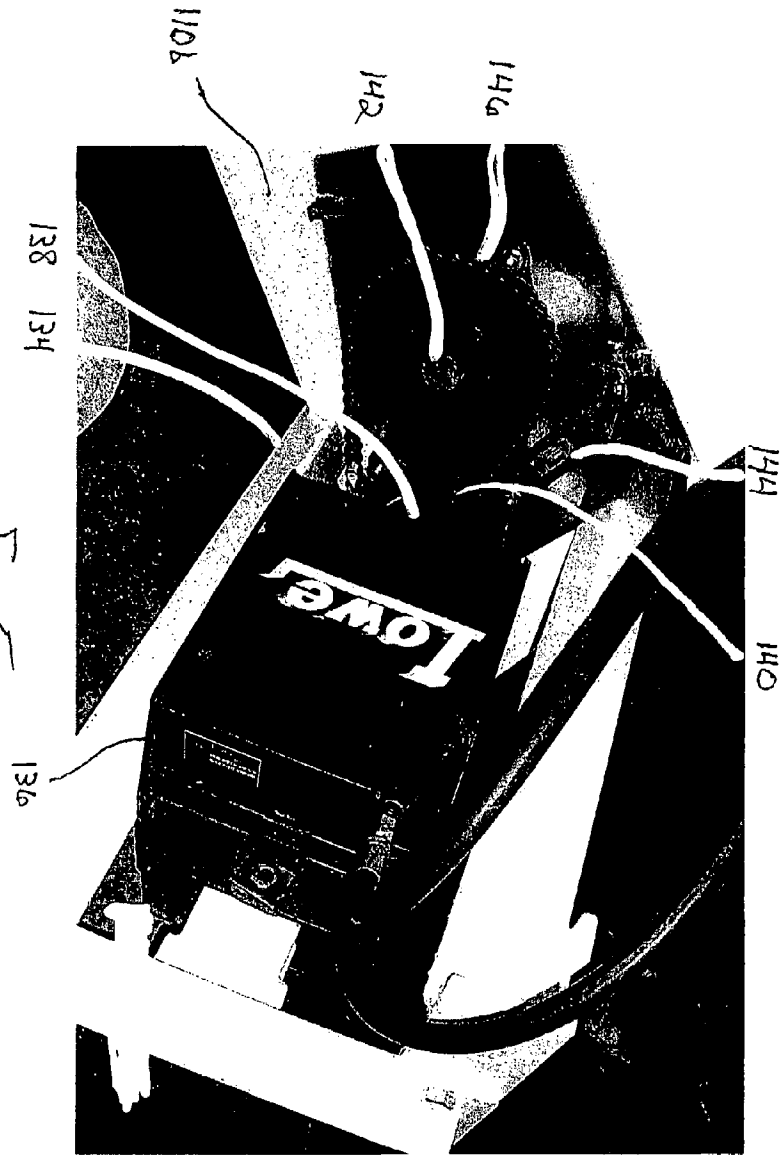
FIG. 5 is a perspective view of a drive assembly for use with the erosion control device of FIG. 1*a*.

As illustrated in FIGS. 1*a* and 1*b*, a drive assembly 133 can be mounted exterior to the loading box 102 on side wall 110*b*. As shown in FIG. 5, drive assembly 133 generally comprises a drive mount 134, a drive motor 136, a drive shaft 138, an auger sprocket and bearing assembly 140, a beater bar sprocket and bearing assembly 142, an idler assembly 144 and a drive chain 146. Drive motor 136, auger sprocket and bearing assembly 140 and beater bar sprocket and bearing assembly 142 can be sized so as to turn a varying rates based on the type of filler material and the desired rate of barrier formation. For instance, drive assembly 133 can be configured to turn the auger sprocket and bearing assembly 140 at 75 revolutions-per-minute while the beater bar sprocket and bearing assembly 142 turns as 30 revolutions-per-minute. Drive motor 136 can comprise any of a variety of suitable motors such as, for example, a pneumatic motor, a hydraulic motor, an electric motor, an internal combustion motor or any of a variety of hybrid motors. A drive shroud 147 can be mounted over the accessible moving components of drive assembly 133 to increase operator safety.

Figure 3:
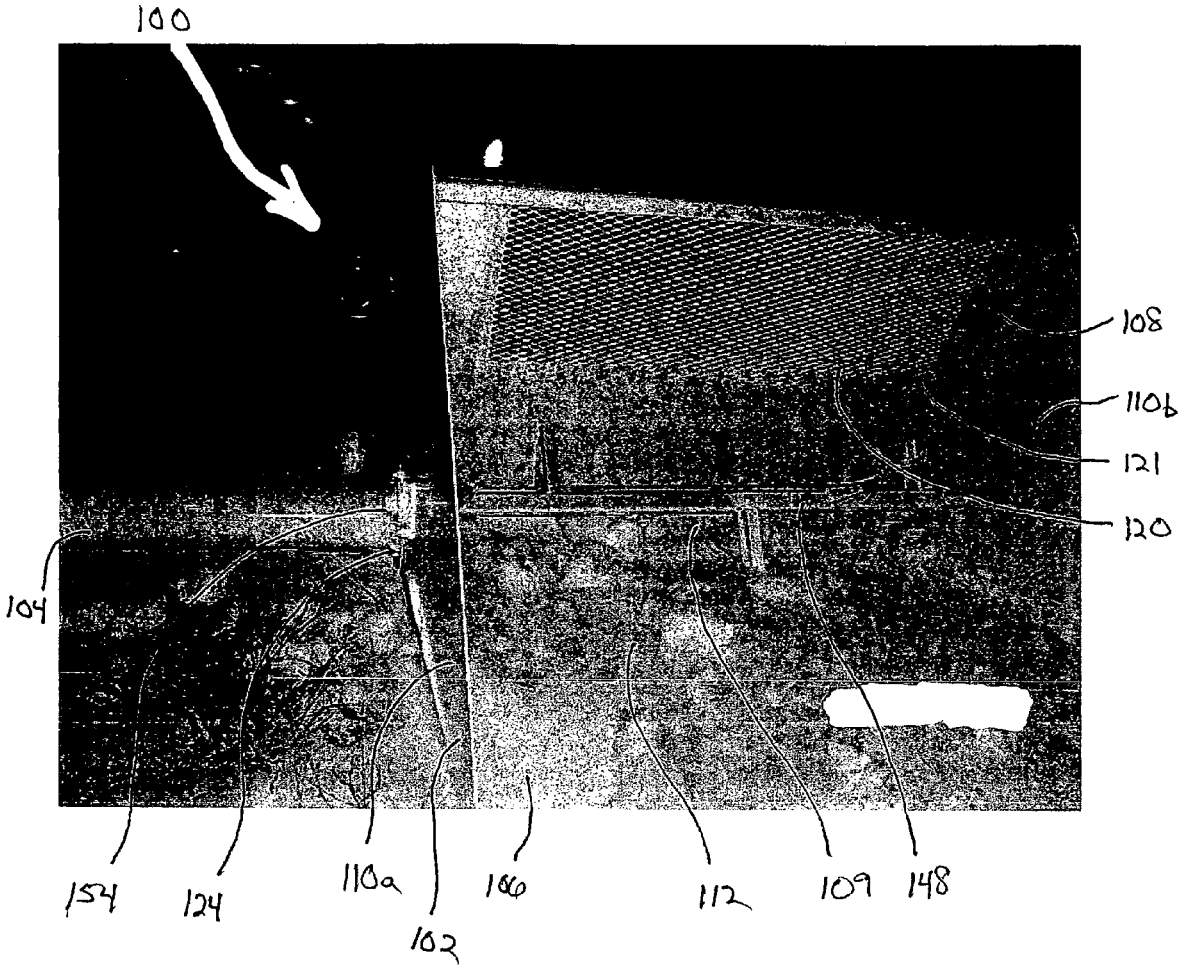
FIG. 3 is a front perspective view of the erosion control device of FIG. 1*a*.

A rotatable beater bar assembly 148 as illustrated in FIGS. 1*a* and 3 can be operably mounted between side walls 110*a*, 110*b* so as to reside within material hopper 112. Beater bar assembly 148 generally comprises a beater shaft 150 and a plurality of spaced apart agitation members 152. Shaft 150 is operably coupled to the beater bar sprocket and bearing assembly 142 in side wall 110*b* and to a beater bar bearing 154 in side wall 110*a*. Beater bar assembly 148 is positioned and mounted within the material hopper 112 such that as the beater shaft 150 rotates, agitation members 152 avoid direct physical contact with the bottom wall 106 and the top wall 108.

An auger assembly 156 as illustrated in FIGS. 1*a* and 1*b* can be positioned so as to operably extend from side wall 110*b* and reside within continuous pipe member 123 such that the auger assembly 156 is present in the filling chute 104 and auger chute 109 and is disposed substantially parallel to beater shaft 150. Auger assembly 156 generally comprises a coupling end 158 operably connected to the auger sprocket and bearing assembly 140 and a compaction end 160. Auger assembly 156 has a selected length such that the compaction end 160 does not fully extend the length of filling chute 104 such that a compaction space 162 is defined between the compaction end 160 and the chute discharge end 127. Auger assembly 156 has a continuous auger blade 164 extending between coupling end 158 and the compaction end 160. Auger blade 164 can comprise a wear surface 166 proximate the compaction end 160. Wear surface 166 can provide reinforcement and longer life to the auger assembly 156 by accommodating increased compaction forces generally encountered proximate the compaction space 162. Wear surface 166 can comprise a suitable material such as, for example, welding wire welded to the auger blade 164. Compaction space 162 can comprise a selected compaction length 167 dependent upon the diameter of auger assembly 156 and continuous pipe member 123 though compaction length 167 generally exceeds at least about 3 inches for an 8 inch chute diameter 125 and exceeds at least about 8 inches for a 12 inch chute diameter 125.

In use, erosion control device 100 can be attached and manipulated by a transport vehicle 200 as illustrated in FIGS. 6, 7, 8 and 9. Transport vehicle 200 can comprise any suitable vehicle such as, for example, a skid-steer, a front end loader, a tractor and other suitable implements. Generally, transport vehicle 200 can comprise a lifting arm assembly 202 capable of engaging the attachment mount 122. In addition, transport vehicle 200 can comprise a power-take-off assembly wherein the transport vehicle 200 can be operably connected to the drive motor 136 such as, for example, with pneumatic hoses 204 for powering the drive motor 136.

Figure 6:
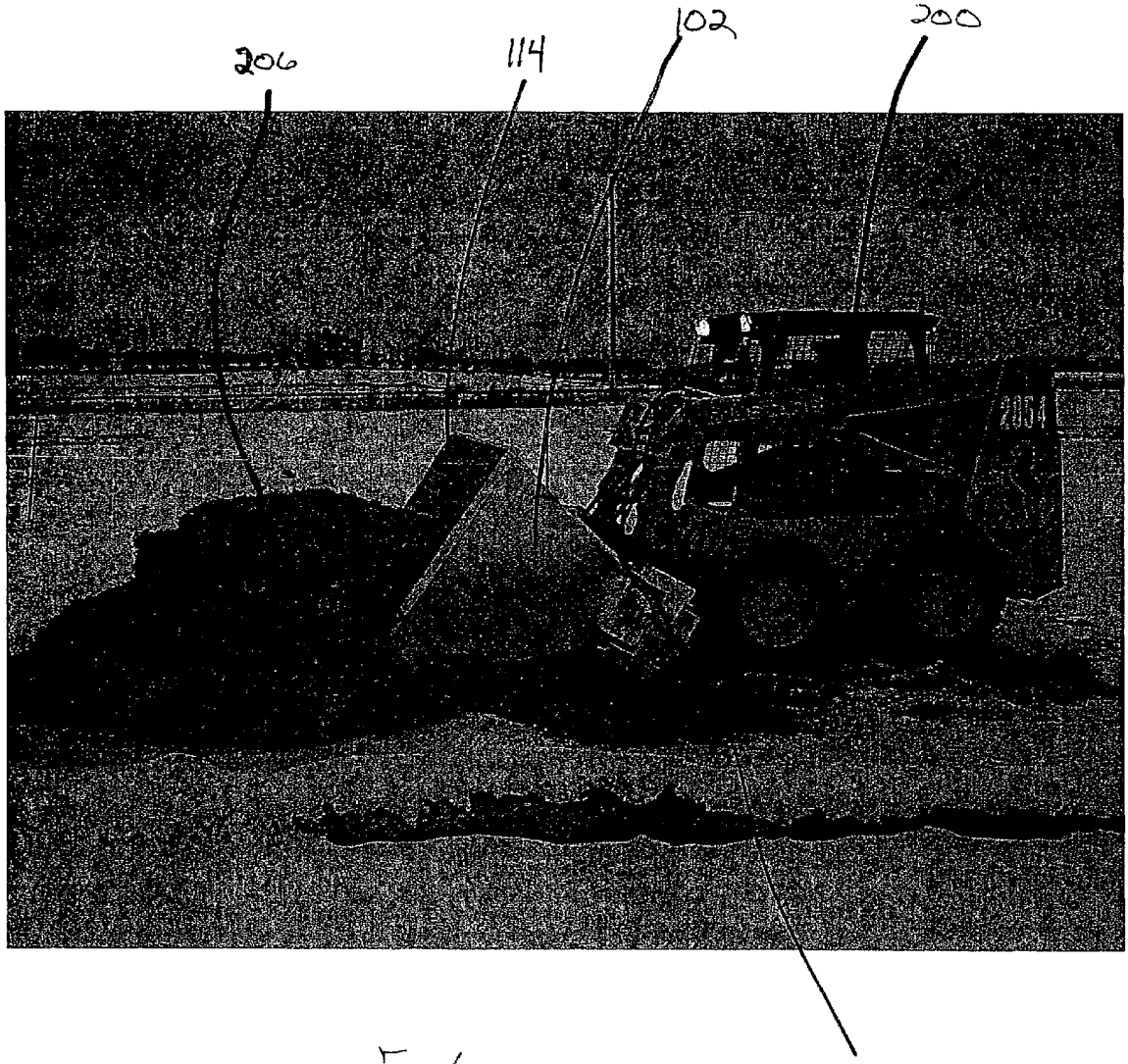
FIG. 6 is a perspective view of the erosion control device of FIG. 1*a* in use with a transport vehicle for scooping a bulk filler material.
Figure 7:
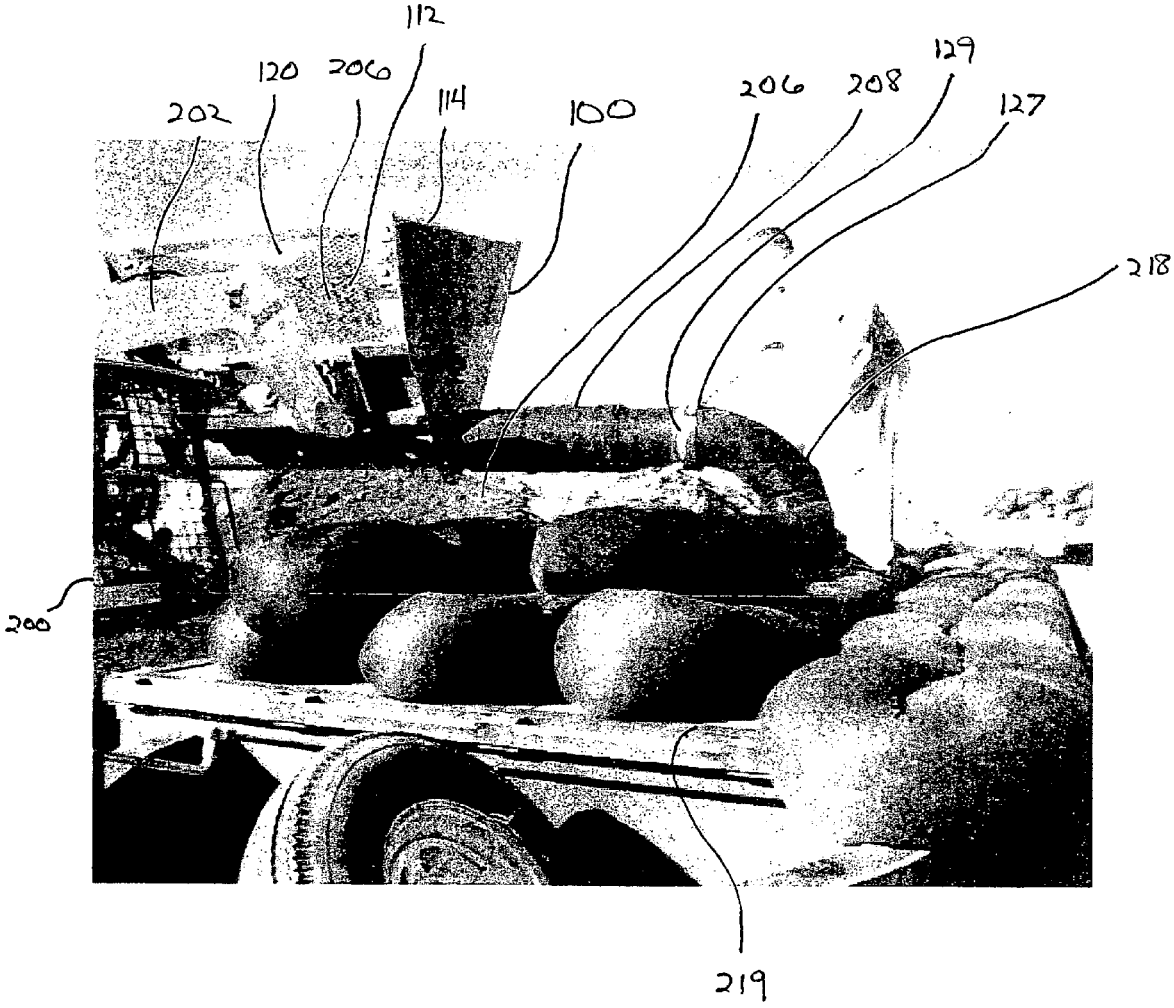
FIG. 7 is a perspective view of the erosion control device of FIG. 1*a* in use with a transport vehicle for forming a filled barrier bag for placement on a transport vehicle.

After the erosion control device 100 has been attached to the transport vehicle 200, an operator can manipulate the loading box 102 such that the bottom wall 106 is substantially parallel to and proximate the ground. The operator then directs the transport vehicle 200 such that the leading edge 118 is directed into a bulk pile of a filler material 206 as shown in FIG. 6. Filler material 206 can comprise a wide variety of materials based on available resources and the functional purpose of a filled barrier bag. Representative filler materials 206 can comprise mulch, wood chips, sawdust, compost, gravel, sand, oil-absorbent materials and other suitable materials and combinations thereof. After the filler material 206 has entered the material hopper 112, the operator can orient the loading box 102 such that the loading opening 114 is upwardly facing as shown in FIG. 7. As illustrated in FIG. 7, an operator can view material hopper 112 through the viewing portion 120 such that the operator can verify that filler material 206 is present within the loading box 102. Once the filler material 206 has been captured with the loading box 102, the operator directs the transport vehicle 200 to place of deployment for a filled barrier bag.

Figure 10:
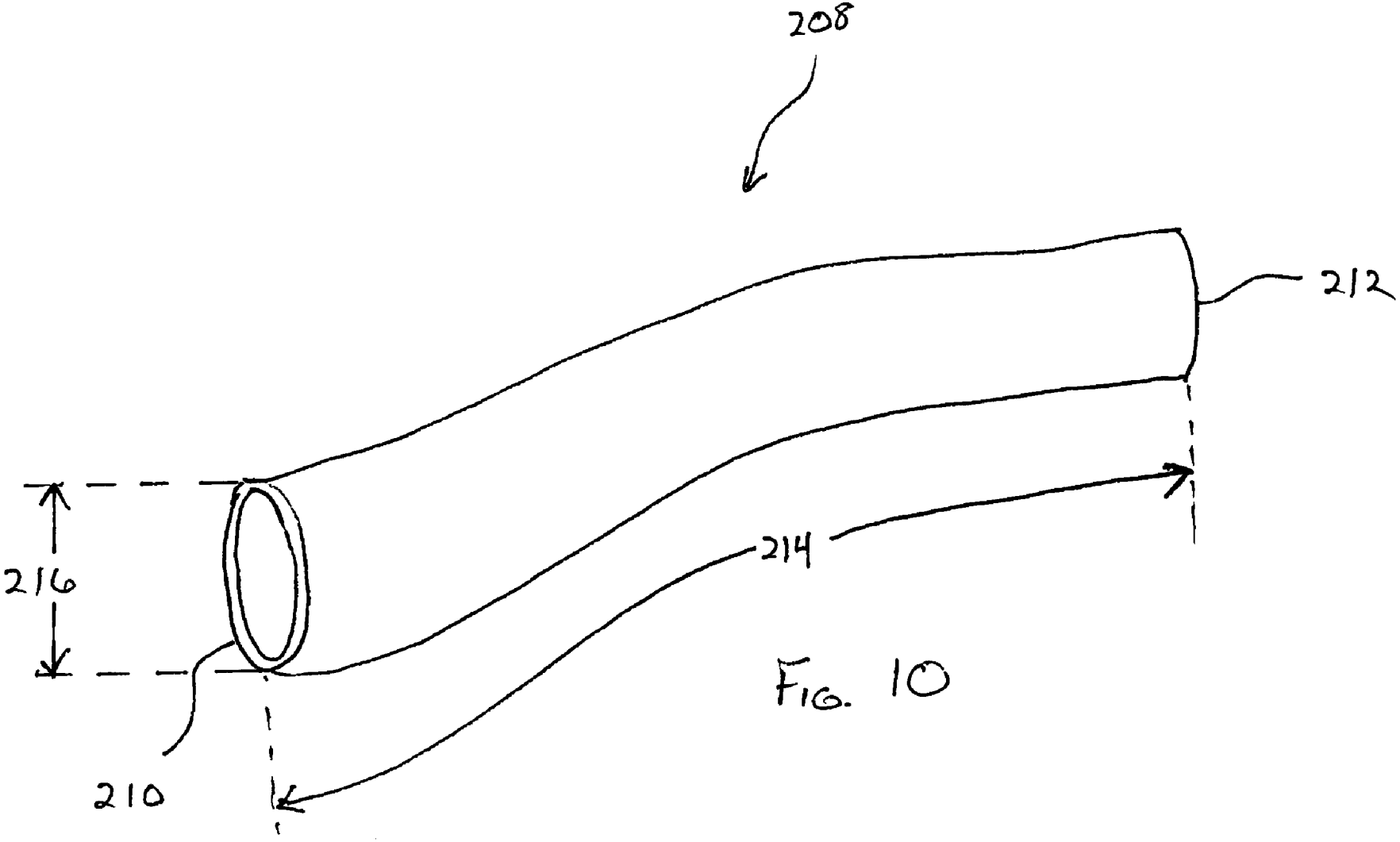
FIG. 10 is a perspective view of a barrier bag for use with the erosion control device of FIG. 1*a*.

Either prior to or following the capture of the filler material 206 within the loading box 102, an empty barrier bag 208 shown in FIG. 10 can be retainably positioned over the chute discharge end 127. Barrier bag 208 can comprise suitable materials of construction such as, for example, plastic, reinforced plastic, fiberglass, burlap or other suitable material. Barrier bag 208 generally comprises a continuous bag having an open end 210 and a closed end 212 set apart by a bag length 214. Bag length 214 can comprise any suitable length such as, for example, between about 10 feet to about 400 feet. Barrier bag 208 has a bag diameter 216 substantially equivalent to chute diameter 125. Barrier bag 208 can be attached to the filling chute 104 by stretching the open end 210 over the bag attachment member 129 such substantially all of the bag length 214 is positioned over the filling chute 104 and the closed end 212 is positioned proximate the chute discharge end 127.

After the barrier bag 208 has been attached to the filling chute 104 and the operator has positioned the loading box 102 at a desired location for forming a filled barrier bag, the operator commences operation of the drive motor 136 such as, for example, by initiating power from the power-take-off on transport vehicle 200. As operation of the drive motor 136 commences, drive chain 146 simultaneously interacts with the auger sprocket and bearing assembly 140 and the beater bar sprocket and bearing assembly 142 such that both the beater bar assembly 148 and auger assembly 156 begin turning. With the loading box 102 oriented such that loading opening 114 is upwardly facing, filler material 206 is generally gravity fed into the auger chute 109. As the beater bar assembly 148 spins within the material hopper 112, the agitation members 152 continually agitate, separate and break-up the filler material 206 so as to provide a generally consistent flow of filler material 206 into the auger chute 109.

Figure 8:
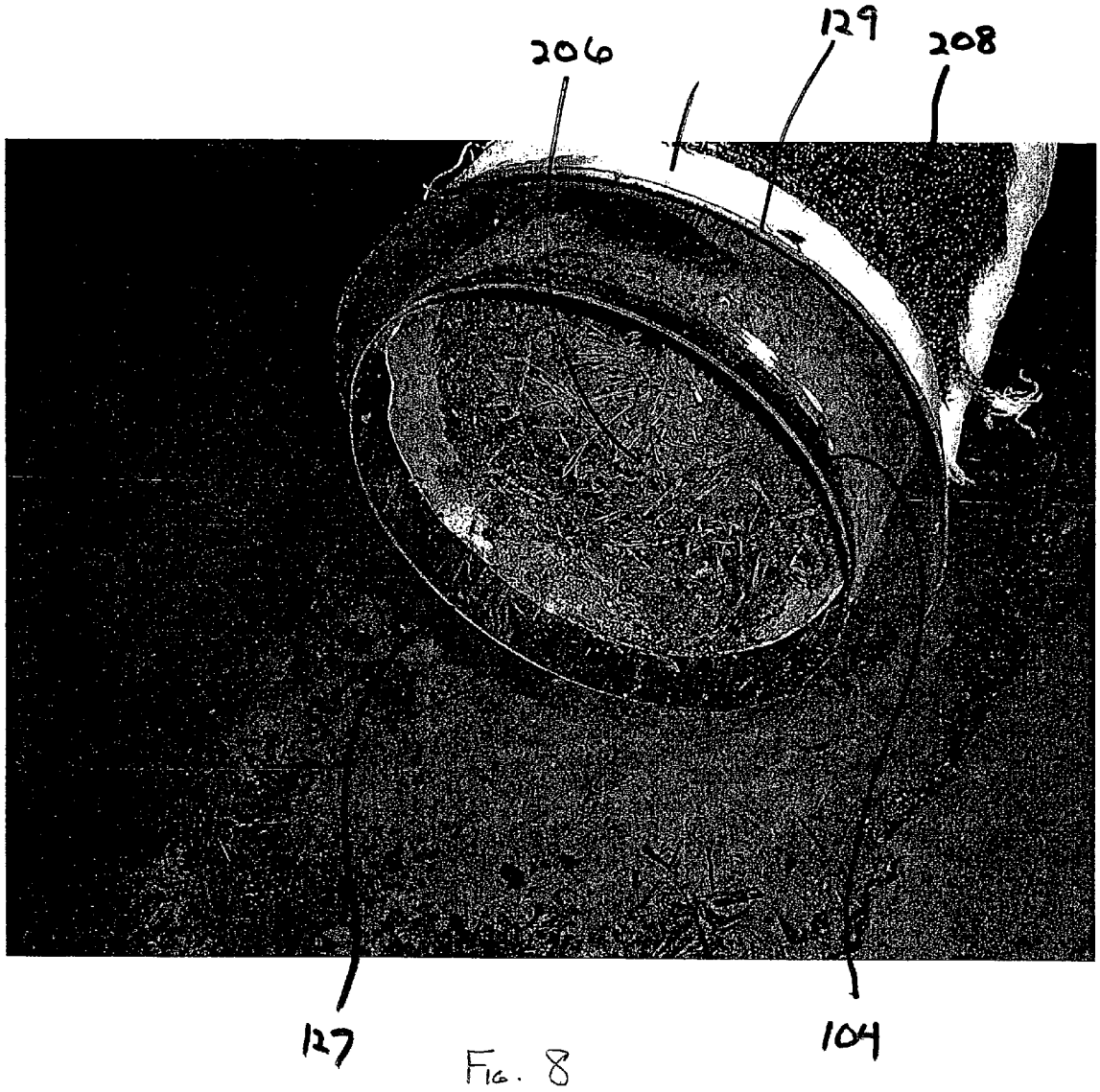
FIG. 8 is a perspective view of a chute discharge end on the erosion control device of FIG. 1*a* including a compacted filler material.

As the filler material 206 enters the auger chute 109, the filler material 206 encounters the auger blade 164. As the auger blade 164 spins, the filler material 206 within the auger chute 109 is directed from the material hopper 112 into the filling chute 104. The filler material 206 is transported to the compaction end 160 wherein the filler material 206 enters the compaction space 162 beyond the end of auger blade 164. Within compaction space 162, the continuous flow of filler material 206 from the material hopper 112 causes the filler material 206 to compact as shown in FIG. 8. This compaction creates frictional wear forces on the auger blade 164 that are accommodated with wear surface 166 so as to avoid premature wear and failure of the auger blade 164.

Figure 9:
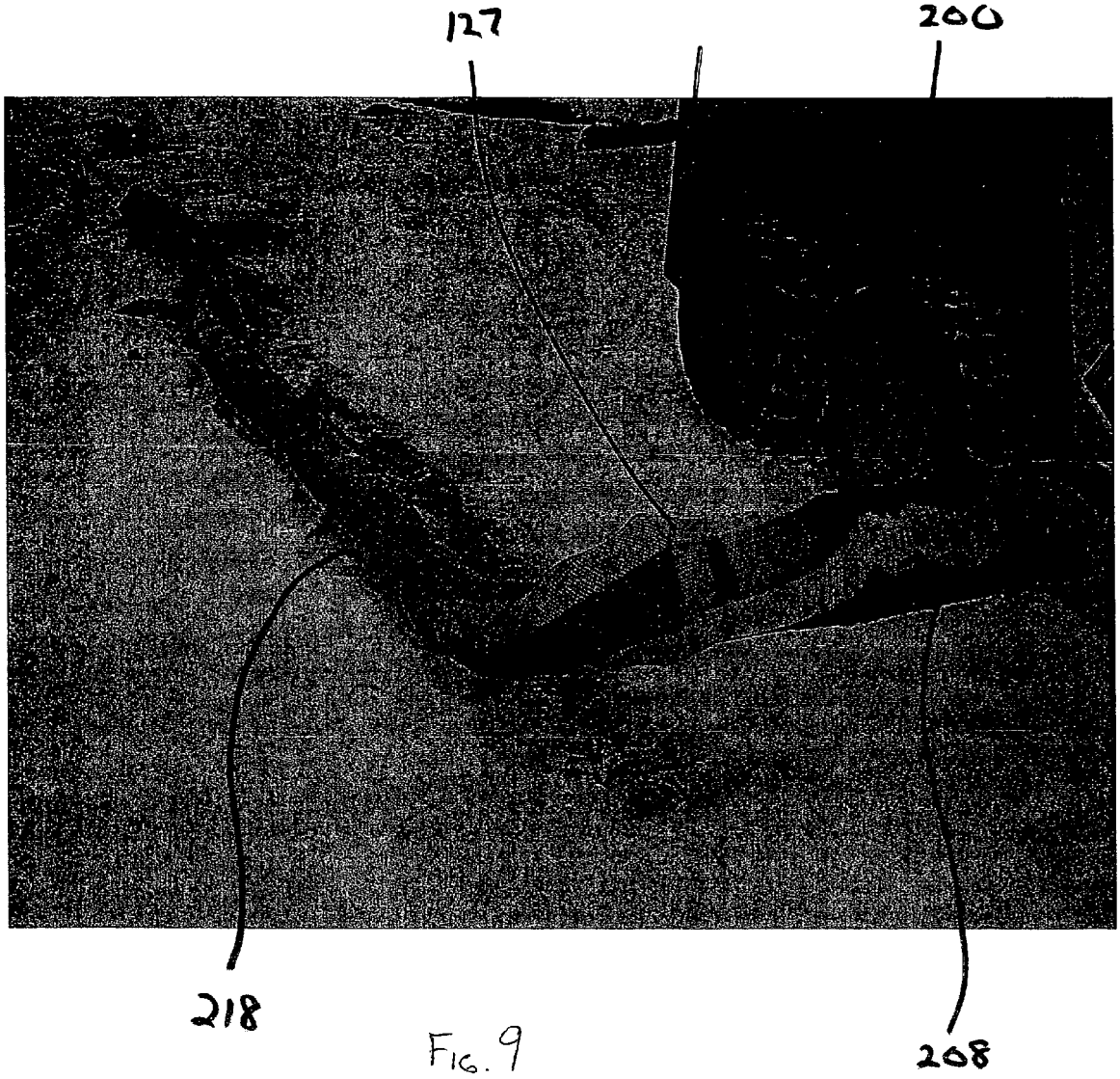
FIG. 9 is a perspective view of a filled barrier bag being formed and positioned by the erosion control device of FIG. 1*a* and a transport vehicle.

As auger blade 164 continues to rotate and transport filler material 206 into and through filling chute 104, the compacted filler material 206 within compaction space 162 exits the chute discharge end 127. As the compacted filler material 206 exits filling chute 104, the filler material 206 contacts the closed end 212 of barrier bag 208. The force and movement of the filler material 206 results in closed end 212 of barrier bag 208 being directed away from the chute discharge end 127 wherein more of the barrier bag 208 is pulled over the bag attachment member 129. As the chute discharge end 127 is generally positioned above the ground, closed end 212 of a filled barrier bag 218 falls to the ground to define a starting point for the barrier. As the filler material 206 continues to fill the barrier bag 208, the operator directs the transport vehicle 200 along a desired barrier path such that as filled barrier bag 218 is formed, it is deployed onto the ground along the barrier path as illustrated in FIG. 9. When the operator reaches an end-point of the barrier path or when the open end 210 of the barrier bag is deployed from the filling chute 104, the operator can terminate the operation of drive motor 134 so as prevent additional filler material 206 from being transported and compacted by the auger assembly 156. At this point, the operator can close the open end 210 with a bag tie or suitable closure member or alternatively, can cut the barrier bag 208 so as to separate the filled barrier bag 218 from an undeployed portion of the barrier bag 208. When barrier bag 208 is cut, the operator must close the cut end of the barrier bag 208 proximate the chute discharge end 127 to form a new closed end 212. The operator can then position the transport vehicle 100 for construction of a new barrier path or to scoop and fill the material hopper 112 with an additional amount of filler material 206. As illustrated in FIG. 7, filled barrier bag 218 can be formed and positioned on a storage trailer 219 wherein the filled barrier bag 218 can be transported for deployment and use at a location remotely located from the erosion control device 100.

As contemplated herein, filled barrier bag 218 can perform a variety of functions based upon the materials selected for the filler material 206 and barrier bag 208. In one presently contemplated embodiment, filled barrier bag 218 can function as an erosion prevention wall so as to prevent ground erosion by wind or water. Filled barrier bag 218 can be especially beneficial in a construction environment wherein much of the surrounding land has been graded or disturbed such that foliage such as grass, trees and shrubs is not present to prevent erosion. Alternatively, filled barrier bag 218 can be constructed so as to selectively absorb spilled materials such as, for example, chemical or fuel spills. For instance, filled barrier bag 218 can be constructed of a porous barrier bag and an absorbent filler material so as to absorb and contain the spill.

Figure 11:
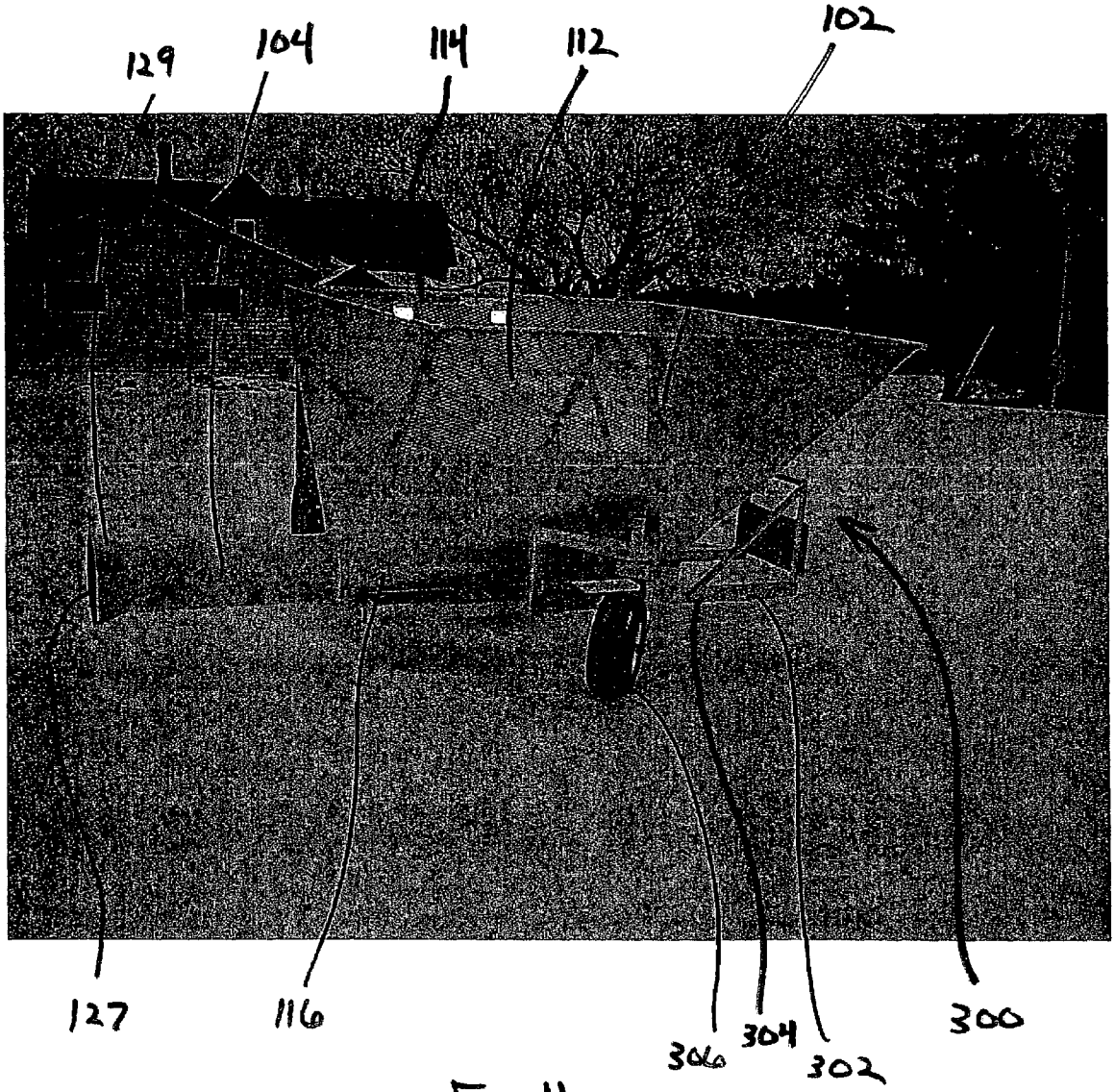
FIG. 11 is a perspective view of an alternative embodiment of a towable erosion control device.
Figure 12:
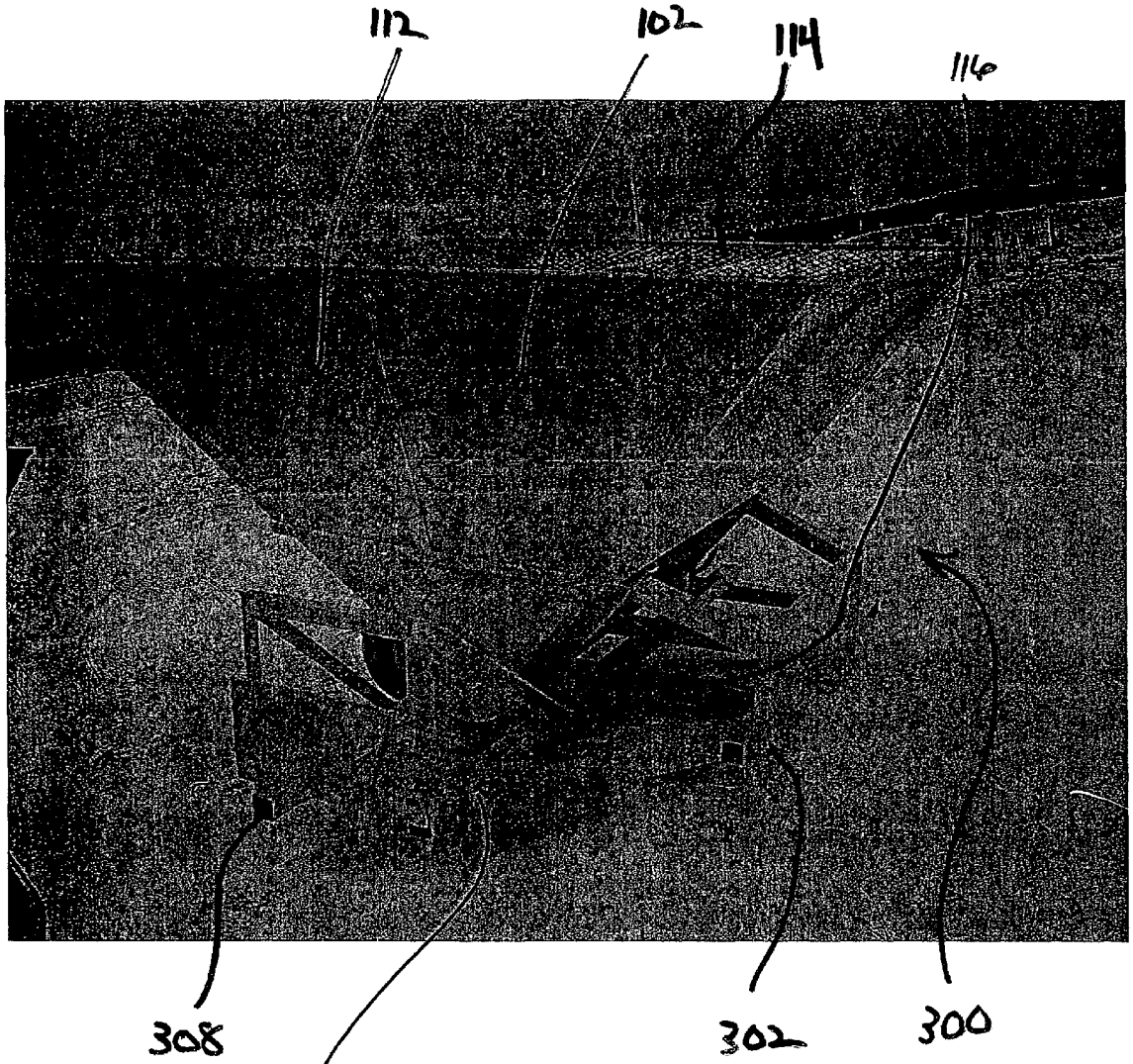
FIG. 12 is a perspective view of the towable erosion control device of FIG. 11.
Figure 12:
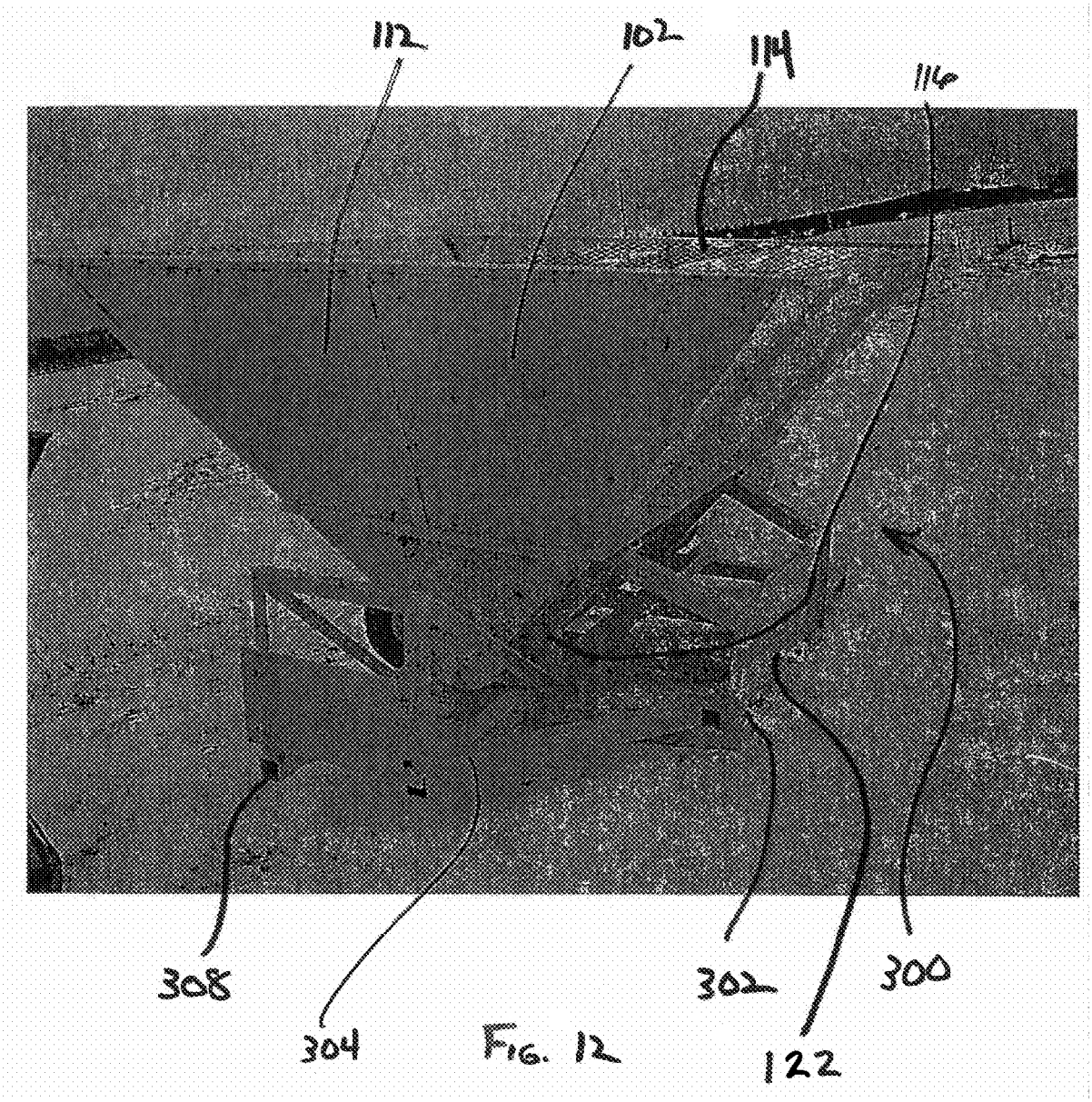

Another representative embodiment of an erosion control device 300 is illustrated in FIGS. 11 and 12. Erosion control device 300 can be substantially similar to erosion control device 100 with the further inclusion of a transport structure 302. Transport structure 302 can comprise a support structure 304 including a plurality of support wheels 306. Transport structure 302 can further include a tow hitch 308.

Erosion control device 300 can be manipulated and operated in two distinct modes. First, erosion control device 300 can be manipulated in a substantially similar manner as previously described with respect to erosion control device 100 wherein transport vehicle 200 attaches to an attachment mount 122 on the erosion control device 300. Utilizing the lifting arm assembly 202, the transport vehicle can manipulate the erosion control device 300 as previously describe with respect to erosion control device 100.

Alternatively, erosion control device 300 can be attached to a truck, bulldozer or similar utility vehicle utilizing the tow hitch 308. In this manner, erosion control device 300 can be towed to points-of-use on a road or highway and similarly pulled along a desired path for forming a barrier. When erosion control device 300 is operated in a towed configuration, the loading box 102 is filled with the filler material 206 utilizing an additional scooping vehicle such as, for example, a front-end loader, bucket loader or Bobcat style vehicle.

Although various embodiments of the invention have been disclosed here for purposes of illustration, it should be understood that a variety of changes, modifications and substitutions may be incorporated without departing from either the spirit or scope of the present invention.

What is claimed is:

1. An erosion control device for constructing an erosion control wall comprising:

a loading box for holding a filler material, the loading box having a material hopper, a filling chute and an implement attachment interface;

the loading box further including a rotatable beater assembly and a rotatable auger assembly driven by a drive assembly wherein the rotatable beater assembly rotates through the filler material so as to allow the filler material to flow into the rotatable auger assembly;

the rotatable auger assembly including a first auger portion that operably resides within the material hopper and a second auger portion that operably resides within the filling chute;

the filling chute further including a compaction space defined between the second auger portion and a discharge end of the filling chute;

wherein the compaction space is sized so as to compact the filler material before exiting the filling chute discharge end; and wherein the discharge end includes a flared collar with a tension member and is shaped to couple with erosion control bags that receive compact filler material from the filling chute and to directly deploy the erosion control bags along an operator directed path at a desired point of use or transport.

2. The erosion control device of claim 1, wherein the drive assembly operably interconnects with a power take-off on a transport vehicle, the drive assembly rotatably driving both the beater assembly and the compacter assembly.

3. The erosion control device of claim 1, wherein the compaction space is at least 3 inches.

4. The erosion control device of claim 1, wherein the auger assembly further comprises a wear surface.

5. The erosion control device of claim 1, wherein the material hopper comprises a leading edge adapted for scooping a bulk amount of the filler material.

6. The erosion control device of claim 1, wherein the material hopper comprises a viewing portion visibly accessible to an operator when the implement attachment interface is operably engaged with an operator-controlled implement.

7. An erosion control system comprising:

a loading box having a material hopper, a filling chute and an implement attachment interface, the loading box further including a means for agitating a filler material within the loading box, a means for filling an erosion control bag, and a means for driving the agitating means and the filling means, wherein the means for agitating the filler material promotes flow of the filler material into the means for filling and wherein the means for filling compacts the filler material through the filling chute and into an erosion control bag that is retained by a flared collar and tension member on the filling chute; and a transport vehicle having an engagement member adapted for coupling to the implement attachment interface, the transport vehicle adapted to carry the loading box so as to direct placement of a filled erosion control bag along a path defined by the transport vehicle directly at a point of use or transport for the erosion control bag.

8. The erosion control system of claim 7, wherein the means for loosening comprises a rotatable beater bar.

9. The erosion control system of claim 7, wherein the means for filling comprises an auger assembly and a compaction space.

10. The erosion control system of claim 7, wherein the means for loosening and the means for filling are driven with a gear box, the gear box being operably coupled to a power take-off on the transport vehicle.

11. The erosion control system of claim 7, wherein the transport vehicle adjustably positions the loading box between a raised bag-filling orientation and a lowered material-scooping orientation.

12. The erosion control system of claim 7, wherein the transport vehicle is selected from the group consisting of: a skid steer, a front-end loader and a farm tractor.

13. A method for constructing a temporary erosion control wall comprising:

loading a material loading box with a filler material;

attaching a continuous bag to a filler chute on a material loading box, the continuous bag having an open end, a minimum length of ten feet, and a closed end, the open end being retainably positioned and gathered over a flared collar having a tension member on the filler chute such that the closed end is proximate a chute opening;

compacting the filler material into the filler chute such that a compacted filler material is advanced through the filler chute and into the continuous bag, the compacted filler material contacting the closed end where a filled bag deploys from the filler chute directly to a point of use or transport; and attaching the material loading box to a transport vehicle, the transport vehicle positioning the material loading box such that the filled bag is continually deployed at a desired location.

14. The method of claim 13, further comprising:

loosening the filler material within the material loading box with a rotating beater bar.

15. The method of claim 13, where loading the material loading box with filler material comprises scooping filler material from a bulk pile.

16. The method of claim 13, further comprising:

separating the filled bag from the filler chute.

* * * * *

UNITED STATES PATENT AND TRADEMARK OFFICE

CERTIFICATE OF CORRECTION

PATENT NO. : 7,654,292 B2
APPLICATION NO. : 11/332769
DATED : February 2, 2010
INVENTOR(S) : Roger Sweningson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 938 days.

Signed and Sealed this

Twenty-third Day of November, 2010

David J. Kappos

David J. Kappos
*Director of the United States Patent and Trademark Office*